United States Patent [19]

Ridgeway

[11] Patent Number: 4,923,065

[45] **Date of Patent: * May 8, 1990**

[54] MEMBRANE PACKING AND RETAINER

[76] Inventor: Louis H. Ridgeway, 5835 Leadrope Way, Bonita, Calif. 92002

[ * ] Notice: The portion of the term of this patent subsequent to Aug. 1, 2006 has been disclaimed.

[21] Appl. No.: 285,449

[22] Filed: Dec. 16, 1988

Related U.S. Application Data

[63] Continuation-in-part of Ser. No. 162,215, Feb. 29, 1988, Pat. No. 4,852,743.

[51] Int. Cl.[5] ..... B65D 81/02

[52] U.S. Cl. ..... 206/583; 206/453; 206/586; 206/591

[58] Field of Search ..... 206/453, 583, 585, 586, 206/591, 592, 593, 594

[56] References Cited

U.S. PATENT DOCUMENTS

| | | | |
|---|---|---|---|
| 1,456,098 | 5/1923 | Doane | 206/593 |
| 2,501,570 | 3/1950 | Larsen | 206/583 |
| 2,749,012 | 6/1956 | Beach | 206/521 |
| 3,051,345 | 8/1962 | Flynn | 206/593 |
| 3,381,873 | 5/1968 | Hirota | 206/593 |
| 3,521,743 | 7/1970 | Sposito, Jr. | 206/46 |
| 3,523,863 | 8/1970 | Juhos | 206/811 |
| 3,552,595 | 1/1971 | Gerner | 206/583 |
| 3,853,220 | 12/1974 | Luray | 206/466 |
| 4,491,225 | 1/1985 | Baillod | 206/521 |
| 4,604,459 | 8/1986 | Luray | 206/583 |
| 4,606,459 | 8/1986 | Luray | 206/583 |
| 4,606,460 | 8/1986 | Luray | 206/583 |

FOREIGN PATENT DOCUMENTS

| | | | |
|---|---|---|---|
| 3340155 | 4/1984 | Fed. Rep. of Germany | 206/591 |
| 380271 | 4/1939 | Italy | 206/453 |
| 135796 | 11/1978 | Japan | 206/583 |
| 685567 | 9/1979 | U.S.S.R. | 206/593 |
| 827346 | 5/1981 | U.S.S.R. | 206/583 |
| 475299 | 11/1937 | United Kingdom | 206/583 |
| 1224493 | 3/1971 | United Kingdom | 206/586 |

*Primary Examiner*—David T. Fidei

*Attorney, Agent, or Firm*—Henri J. A. Charmasson

[57] ABSTRACT

A pair of rigid frames having central openings are each covered with a pliable material which is forced in intimate contact with a fragile article to be packaged. Central openings allow passage of the fragile article which is suspended between the two pliable materials. Pliable material and friction limits the handling shock-type loads which may be transmitted to the fragile article in one direction, and cushions loads in other directions. Frames can be positioned within an enclosure package so that motion of the fragile article during handling can be tolerated. A single pair of pliable covered frames can serve as packing for a wide variety of solid materials, including multiple items or irregular shapes and heavy articles, with no further protection required.

6 Claims, 4 Drawing Sheets

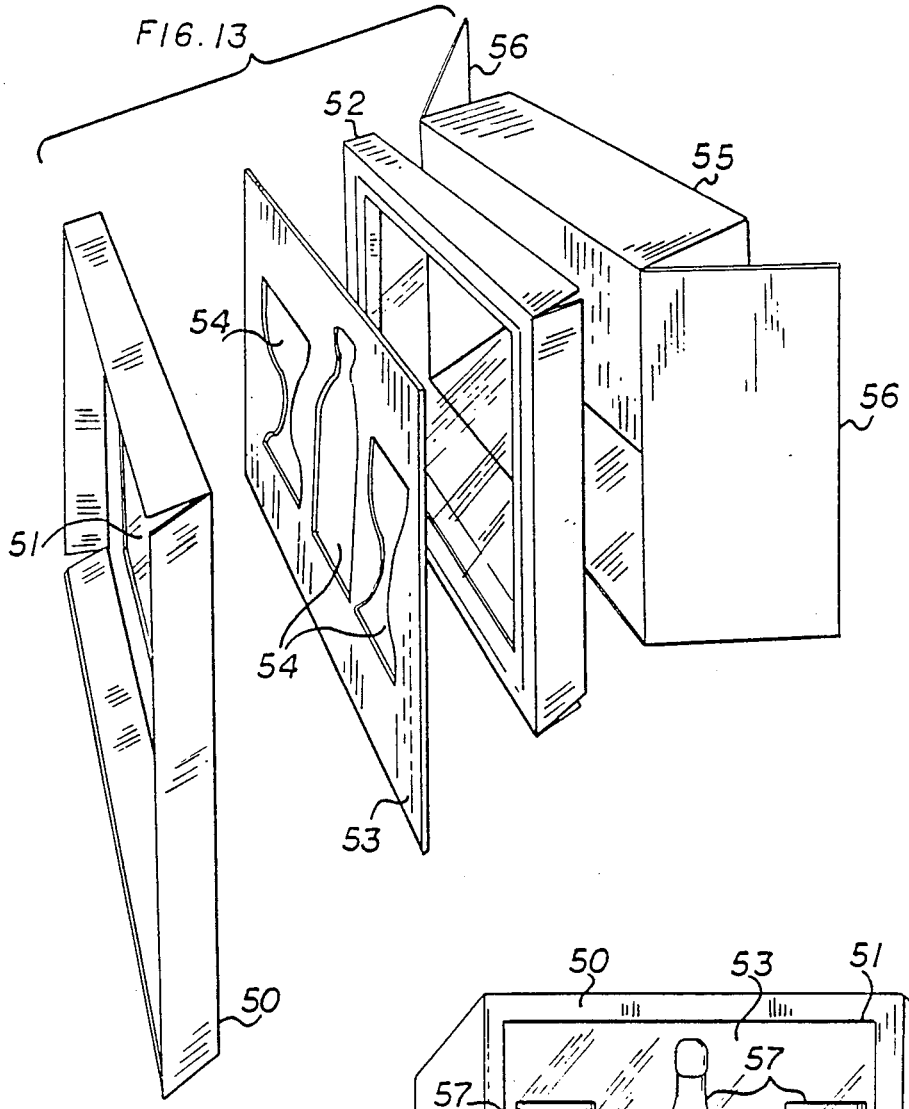
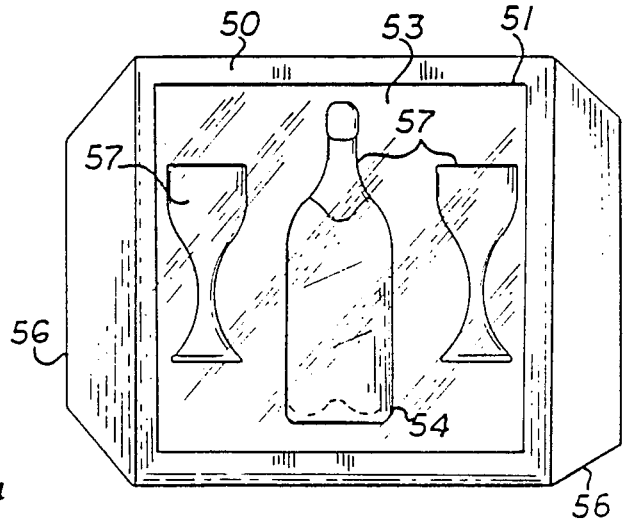
FIG. 14

MEMBRANE PACKING AND RETAINER

CONTINUATION-IN-PART

This application is a continuation-in-part of co-pending application Ser. No. 162,215 now U.S. Pat. No. 4,852,743, filed on Feb. 29, 1988.

FIELD OF THE INVENTION

This invention relates to packaging, more specifically to membrane packing, package form inserts and suspension of special shape items.

BACKGROUND OF THE INVENTION

Although a retail package can be decorative and encourage purchase of the enclosed article, the primary purpose of any packaging is to protect the article from shipping and handling damage. Auxiliary packing forms and materials within the package also may have other functions, but again, the primary function is to protect the article from shipping and handling damage.

Packing materials and forms can be separated into 2 categories; (1) interface materials which directly contact the article being protected, and (2) structural materials which support and/or reinforce package and interface materials.

Interface and structural packing materials and forms should be small, light weight, pleasing in appearance and low in cost. However, at the same time, the packing must be able to withstand shipping and handling loads transmitted by the external package or container without transmitting excessive amounts of these loads to the article being protected. Interface and structural packing must also be able to perform it's functions within the limitations of a difficult environment, including extremes of temperature, altitude (pressure), shock, vibration, and stacking of containers and or articles within containers.

INTERFACE MATERIALS AND FORMS

A variety of approaches to packing articles within shipping containers are currently available. One approach uses interface and structural fill materials within a container, possibly the package itself. The fill material may be foam, wood chips, tissue (paper), excelsior, gray chip dunnage, dimpled kraft, foam sheeting, newspaper or elastomeric materials.

A modification of this combined fill or interface and structural material approach uses inflatable pillows or expanding materials such as foam in place compounds within a container. Example of a pillow type of packing is found in U.S. Pat. No. 3,521,743. The pillow distributes the shipping and handling loads to the many contact points with the article being shipped. A second related approach is to provide a specially shaped restraint within the container. The special shape again distributes shipping and handling loads to the article, but does not require a complete fill within the container. The special shape may be obtained by molding or preforming the restraint to intimately surround the article. This can be accomplished by die cut material stand-offs, built-pads, end caps and spacers generally made from corrugated or solid foam materials. Except for the deformation of the material, the full shipping and handling loads are transmitted to the fragile article.

In another approach, the article is suspended around a structure by attaching elastic cords or other deformable tension type devices acting against gravity and anticipated shipping and handling loads. The structure may be separate from or combined into the external container. This approach is especially useful in withstanding large shipping and handling shock loads with minimum transfer of the load to the article being shipped.

Another approach cradles and suspends the article within a recess in a sheet or film, instead of cords or individual tension devices. Sheets may be include deformable wrapping films, liners, pads, sacks, or other materials. These cradles suspend the article primarily against gravity, allowing limited swing movement in other directions within the container (not a complete fill of the container). These flexible cradles may be suspended and/or further restrained by other rigid materials within the external container, or the external container itself. Examples of internal rigid support materials include struts and stays, cardboard or stiff paper frames.

In a modification to the cradle/hammock approach, 2 or more films are used to obtain suspension type of support and immobilize or encapsulate the article. Heat shrinkable films are a common method of achieving encapsulation. Two sheets or films are held together, encapsulating and/or shrunk around the article and supported from a rigid member. Examples of encapsulated hammock or cradle suspension type of packing are shown in U.S. Pat. Nos. 4,606,460; 4,606,459; 3,853,220; and 2,501,570. Because of the encapsulated approach, swing type of movements are essentially eliminated and except for the deformation of the shrink wrap sheets, the full shipping and handling loads are transmitted to the wrapped, possibly fragile article.

This encapsulated approach has also been used for external packaging, as well as packing within a shipping or handling package. A pre-formed rigid frame, container or package is used to anchor the encapsulated article. The container and article withstand the full shipping and handling loads. Examples include blister packs and rolled drawing containers. These rigid or semi-rigid containers can also be attached to a card to provide a means for rack or hook display. In a modification of this approach, the rigid container is also transparent allowing the customer to fully view the article. In a further modification, package is not pre-formed, but is shrunk fit or formed around the article while the packaging material is flexible (for example using vacuum to draw a thermosetting plastic film around the article), then setting (e.g., thermo-setting material) the previously flexible material to form a rigid container. This approach immobilizes the article and completely encapsulates it.

In still another approach, the membranes encapsulating the article are also used to form a pillow type of support, as previously described. At least one of the membranes is extended to enclose a volume or sealed to another air tight structure to enclose a volume and form an inflatable pillow-like chamber. The pillow may be air tight, or orificed to act as a fluid damped shock absorbing mechanism. An Example of an encapsulated and pillow like support is shown in U.S. Pat. No. 4,491,225.

STRUCTURAL MATERIALS AND FORMS

Nearly all of the interface packing materials, especially sheet type of packing approaches, require rigid support. Support may be attachment directly the external package, but is commonly an internal separator or rigid packing insert.

Planar reinforcing structural material are common. A typical internal separator or insert in composed of folded or cross-locking cardboard sheets. Folds or cross-locking provide structural integrity in several directions. Folds or cross-locking orientation must be retained in position in order to obtain this structural integrity. Interface material support frames are provided in a variety of situations. Interface materials may be attached or blocked by packing support frames.

Corner structural packing forms are also common. Corner forms center and protect the article, especially if the external package is insufficient to protect the article from shocks and loads emanating from the corner (e.g., dropping package on corner). These corner packings may be made from cross braced cardboard-like material or solid inserts placed at the corners.

All the above described approaches rely upon one or more of the following techniques:

(1) the article is encapsulated or otherwise attached to a rigid, structural packing or package member by means of a deformable interface packing member, and/or (2) the article is unattached, but suspended or cushioned by loosely fitting wrap, inflated, filled or crushable interface packing materials, or (3) the article interfaces and is supported by rigid, but deformable or crushable packing or package material.

All of these approaches have the following limitations:

Unless special provisions are made, re-use of packing materials is difficult, requiring refill of loose material, re-encapsulating, reattachment or re-closable rigid packaging material designs.

Multiple articles require added support or attachment to rigid separators and/or added rigid packing materials.

Rigid cardboard-like planar separators or inserts may require folding and/or assembly and restraints to obtain adequate structural integrity.

Many different separators, inserts, sheet materials and other packings are required to be stocked if different items are to be shipped.

Tooling and package filling/closing time and costs are significant.

Extensive or complete contact is required between the article and the packing materials.

SUMMARY OF THE INVENTION

The principal and secondary objects of the invention are:

To provide a packing which suspends a fragile article in a frame without attachment to or encapsulation of the article;

To provide a means to center and suspend the article below the plane of the frame;

To provide a packing which provides an elastic, floating support and limits shipping and handling loads transmitted to the fragile article in specific directions to a specific upper limit;

To provide a packing which does not always require pre-formed and separate rigid material separator or insert within the container;

To provide protection from dust and other contaminants;

To provide a packing which provides stand off within the package, but can be stored flat;

To provide a packing which allows the article to be visually inspected without disassembly;

To provide a universal packing, adaptable to many shapes and sizes;

To provide a packing which reduces filling times; and

To provide a low cost/weight packing which does not require special post-packing treatment.

These and other objects are achieved by sandwiching the article between two pliable and flexible membranes, which are each attached to a separate symmetrical supporting frame. The frames have a central opening over which the pliable material is attached. Attachment of the pliable material may also be used to secure loose folds, flaps and separators to frame, creating a rigid structural packing form. The frames are normally separated, but may be attached to each other or may be biased towards each other by initially loose fitting inserts or flaps to maintain a high-friction contact between the pliable membranes and the article to be shipped.

Multiple items and loose fitting separators may be held between the pliable materials as long as space is available within the frame opening. The technique does not require attachment of the article or spacers since the pression of two pliable membranes against the article and separators is sufficient to immobilize it against forces up to a frictional limit. The pliable membrane may even be punctured (accidentally or otherwise) by sharp points on the article without compromising structural integrity and even further limiting loads on the sharp protrusion. Even if not punctured, sharp points on the article cause the membrane to deform at these points, which further distributes the load. The fragile protruding article may also be protected against dust and other contaminants by the pliable membranes, even if punctured as the membrane remains tight around the protrusion. Exceptionally heavy articles may be partially supported through the pliable membrane.

Attachment to a frame can also accomplish a dual purpose. The separate structure or flaps of the frame may be secured by the attachment means. The pliable membranes remain flexible and are not heated, post treated or pre-formed to protect the article. Shipping and handling loads are transmitted by tension of the pliable membranes and/or friction between the membranes and the article. Large transient drop and/or shock loads to the fragile article are limited by the trampoline like action of the membrane in one direction and friction resistance/deformation and ultimate movement of the article between the membranes in other directions, at least until the article moves to contact an adjacent article or the edge of the frames. Because the pliable materials are flexible and are not heat or vacuum shrunk to tightly wrap around the article, the shocks, shipping and handling loads (up to the friction limit just described) are elastically distributed along the contacting surfaces of the fragile article. If the sheets of pliable material are transparent, inspections of the article is simplified, and aesthetic appeal to the customer can be maintained. In another embodiment, the frames and stretched pliable membranes are combined with covers to form a single piece shipper.

BRIEF DESCRIPTION OF THE DRAWINGS

FIG. 13 shows an exploded view of an alternate multi-article packing; and

FIG. 14 shows an front view of the alternate multi-article packing.

DESCRIPTION OF THE PREFERRED EMBODIMENT OF THE INVENTION

Figure 1:
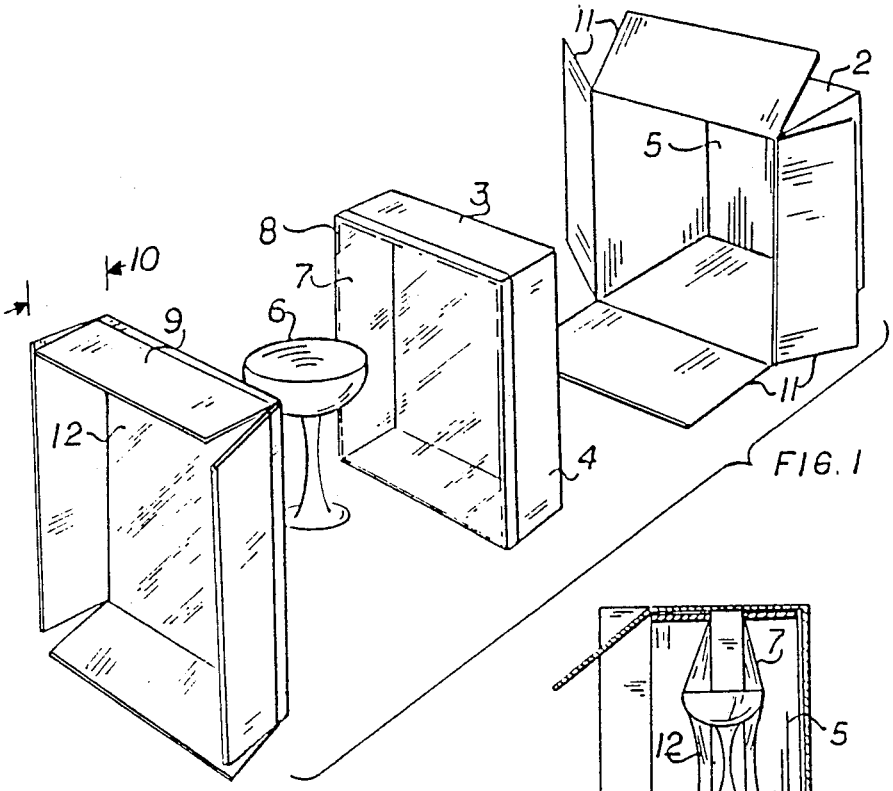
FIG. 1 shows an exploded perspective view of a sheet packing of a glass goblet within a box container.

FIG. 1 shows a exploded perspective view of a sheet packing of a glass goblet within a box container. The rigid or semi-rigid shipping box 2 can be made from cardboard, plastic or other appropriate materials, providing the structural integrity to withstand shipping and handling loads. A first frame 3 fits within the shipping container or box 2, resting the first frame's rear face 4 against the rear face 5 of box 2. First frame 3 may be made from a flat panel, blank or strip of cardboard or other rigid or semi-rigid material, but does not have to be continuous, thus it can be composed of four or more separate strips of rigid planar material or one diecut planar section having flaps which are foldably attached. A space or opening large enough to pass the article 6 is provided in frame 3. The frame mounts a first sheet of pliable material 7 which is transparent in this embodiment, but could as well be opaque. The pliable film in this preferred embodiment is also self adhesive, providing a means for attaching the separated panels or flaps together as well as securing the pliable film or membrane over the front face 8 of the frame. The self-adhesive properties may be obtained by using the clinging properties of some types of film or membrane materials (e.g., vinyl), or applying a coating of tacky material and/or adhesive to the membrane or film.

The sheet 7 may be made from a resilient laminate, woven fabric, netting, vinyl, polyethylene or puncturable elastomeric film. Puncturable film would allow sharp protrusions of article 6 to puncture the film, but not fully tear the material. The sheet of pliable and/or stretchable material 7 is attached over the front face 8 of first frame 3 around the edges. Attachment does not have to extend to all contacting portions of the pliable material to the frame. Attachment may be by means of glue or other adhesive or can rely on the pliable material's contact properties grabbing the edges of first frame 3. The article or solid object 6 being shipped in this embodiment is a fragile glass goblet. An alternate embodiment could have pliable sheet 7 cover only a portion of the front face 8.

A second frame 9 also provides an opening large enough to pass article 6, and is similar in shape and construction to first frame 3. The peripheral flaps are folded and held in position by inserting into the box or external package 2. The depth 10 of second frame 9 can be altered by moving the folding lines of the frame flaps. When the flaps are not folded, the frame can be stored flat prior to use. The second frame depth 10 is selected to resiliently fill shipping box 2 in conjunction with the first frame 3 and the article 6, between rear face 5 and the four top face cover-flaps 11 of box 2, when the shipping box is closed. A second pliable sheet 12 is stretched over the face of second frame 9 and attached to its periphery. When the second frame 9 is held against article 6 and first frame 3, the pliable materials deform around article 6 which is now located within the central openings of both frames. The pliable material is not shrunk or vacuum sealed against article 6, but flexibility of sheets 7 and 12 spread the contact area over a significant portion of article 6, and suspend the article by friction between the pliable sheets.

Figure 2:
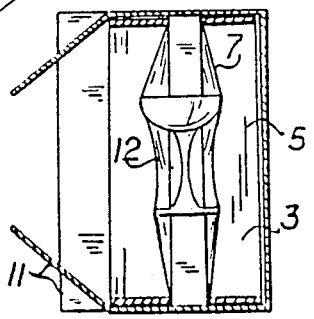
FIG. 2 shows a side cross sectional view of the sheet packing suspending the glass goblet article.

FIG. 2 shows a side cross sectional view of the sheet packing suspending the glass goblet article. Shipping box 2 encloses the packing and article. Shipping and handling loads are transferred from box 2 to frames 3 and 9 which are immobilized in box 2. The goblet 6 is suspended by friction between pliable sheets 7 and 12 pressed against the article 6 by frames 3 and 9 held in place by rear face 5 and front flaps 11 of box 2. The article 6 can translate between pliable sheets 7 and 12 if loads in this direction exceed the frictional force limits. Loads in this direction below the frictional limit and loads in other directions are absorbed by the pliable/-flexible nature of the membrane, acting as a spring to absorb shocks.

Figure 3:
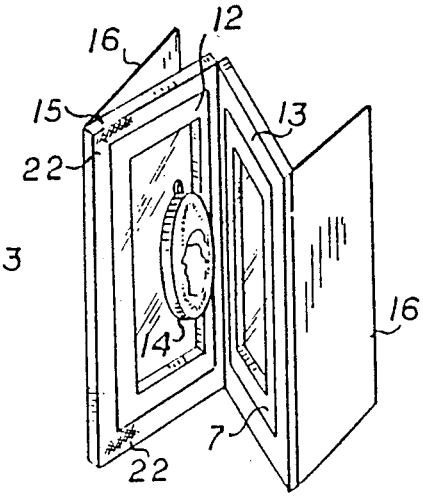
FIG. 3 shows a perspective view of an alternate configuration mailer about to suspend a breakable wall plaque.

FIG. 3 shows a perspective view of an alternate configuration mailer about to suspend a breakable wall plaque 14. The mailer first frame 13 has a first pliable material 7 stretched over one face and over an opening large enough to pass shipping object 14. A mailer second frame 15 is similar in construction, having a second pliable sheet 12 stretched over the face and opening adjoining the first pliable material 7. Two mailer flaps 16 may be integral part of the frame construction or may be attached to the mailer frames which are also bonded together by adhesive 22 to form a single piece construction mailer. The thickness or depth of the mailer frames need not fully enclose the article 14 being shipped, as flaps 16 can be formed to provide additional thickness and protection. Material of mailer frames and flaps can be cardboard, foam core material or other treated paper product. Additional protection can be provided by making the flap out of crushable material.

Figure 4:
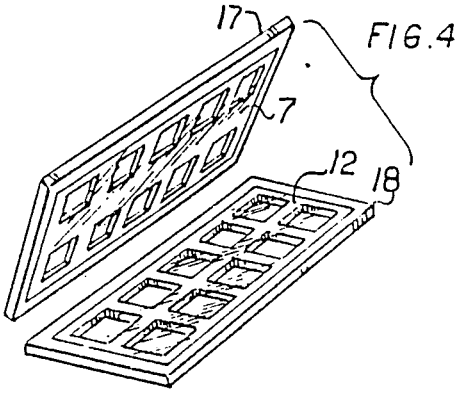
FIG. 4 shows a sheet packing suspending multiple small items.

FIG. 4 shows a sheet packing capable of suspending multiple small items to be shipped. A first frame 17 contains multiple openings which can pass the multiple articles, such as sensitive electronic chips, to be shipped (articles not shown for clarity in this figure). The first sheet of pliable material 7 does not have to be shrinkable or stretched over one face of first frame 17, but is attached to the first frame 17 without significant tensile forces stretching or otherwise applied to the pliable material. A second frame 18 is of similar construction, having a second sheet of pliable material 12 attached, but not stretched over a face of second frame 18. With the frame 18 in a horizontal position, articles placed in the openings will tend to self center and stretching of the pliable material will suspend the center of the article below the plane of the frame. The two symmetrical frames can then be brought and held together in a face-to-face alignment which captures and immobilizes the articles sandwiched therebetween. The frames 17 and 18 normally would be attached as diecut and scored to fold together.

Figure 5:
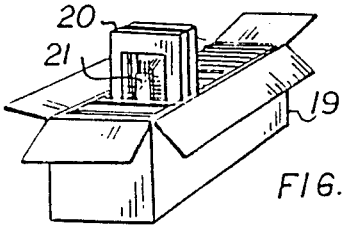
FIG. 5 shows a shipping container with multiple sheet packings.

FIG. 5 shows an alternate shipping container with multiple sheet packings. If article are thinner than the walls of the frames, there is no need for spacers or slots. If the article's size exceed the frame thickness, the multiple shipping container 19 can be slotted on the inside to retain several individual sheet packings 20. The sheet packings are similar to the mailing frames shown in FIG. 3, with or without flap covers 16, enclosing small articles to be shipped 21, such as an electronic chip. Slots in container 19 can hold frames of sheet packings against each other, or the frames may be adhesively attached to each other without slots in container 19 to form the sheet packing prior to inserting into multiple shipping container 19.

The devices and techniques described above can be adapted to accommodate a great variety of articles and container configurations. For example, the thickness or depth of the sheet-supporting frame, the spacing between frames and the contour of the frame can be infinitely varied. The frame may be angular or arcuate, closed or open-ended and held together by outer frames and as illustrated in FIG. 1 or by spacer bracket or bonding material as described in connection with the embodiment of FIG. 3.

Figure 6:
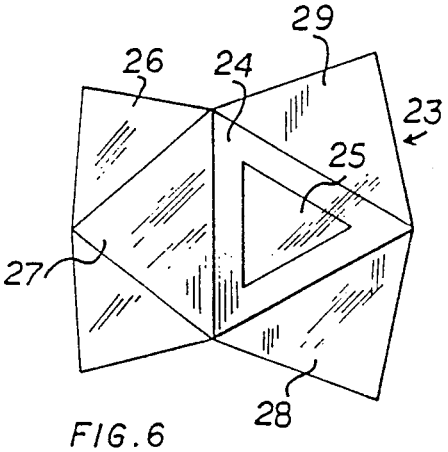
FIG. 6 shows a packing corner form prior to assembly.

FIG. 6 is a planar structural packing member embodiment prior to assembly. A cardboard like planar packing material 23 is composed of a central section 24 having a central opening 25 covered by a transparent film 26, and foldably attached triangular shaped flaps 27, 28 and 29 extending from each of the triangular edges of the central section 24. The transparent film 26 covers the back portions (in this view) of the central section 24 and flaps 27, 28 and 29, and extends beyond the edges of one of the flaps 27. The transparent film in this embodiment has self adhesive surface tension properties.

Figure 7:
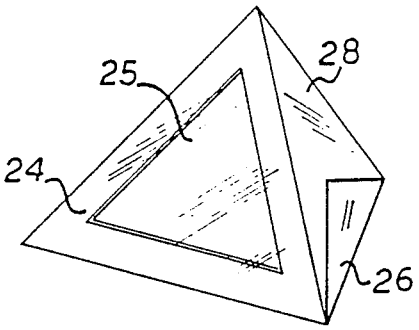
FIG. 7 shows an assembled packing corner form.

FIG. 7 shows the planar cardboard like packing member folded into a pyramidal corner form. All three flaps (two of tree not visible in this view) are folded towards each other and extended portions of the pliable membrane 26 self adhere to adjoining sections (flap 28 shown) and retain adjoining sections into a three dimensional corner form. The central opening 25 continues to be covered by film 26, and can support and protect a corner of an article (not shown for clarity) similar to the support and protection shown in FIGS. 1 and 2.

Figure 8:
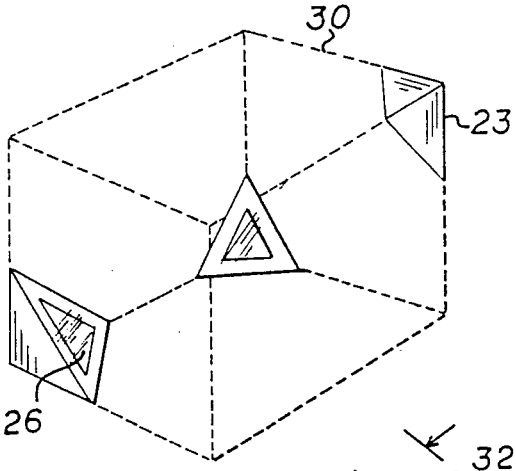
FIG. 8 shows assembled packing corner forms installed within a package.

FIG. 8 shows several assembled packing corner forms, made from planar cardboard 23, within a package 30 (shown dotted for clarity). Film 26 interfaces with a corner of the article being protected (not shown for clarity) and holds the three dimensional form of the previously planar cardboard section without any other means of attachment. A minimum of two corner forms could be used to protect the article or solid object at opposite corners, but corner protection at more than 2 corners is the preferred embodiment. In this embodiment, the external package 30 provides the means for holding the corner form frames apart and against the object to be protected from shipping and handling loads.

Figure 9:
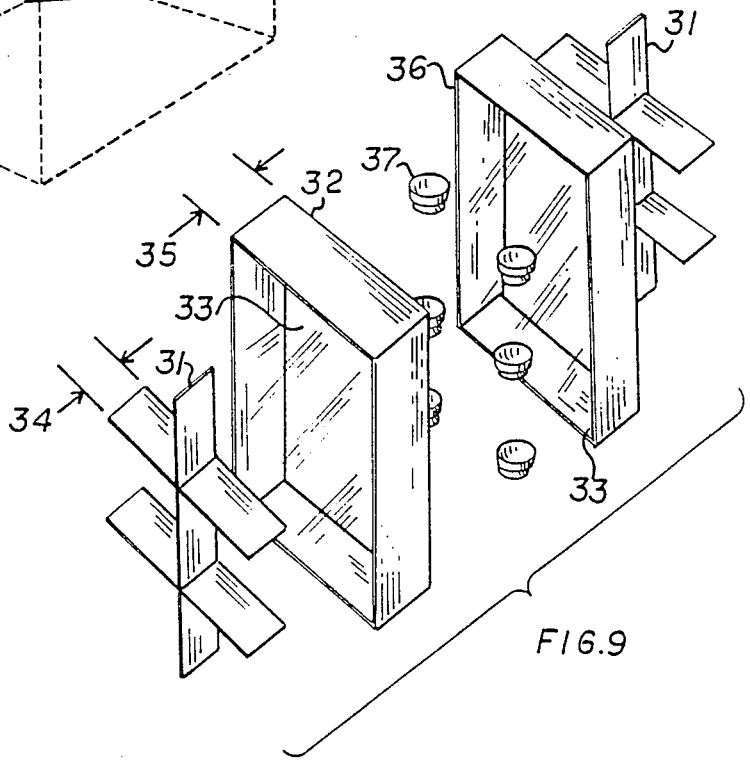
FIG. 9 shows an exploded view of multiple article packing.

FIG. 9 shows is an exploded view of an alternate multiple article embodiment of the invention. Two separators 31 composed of two cross linked planar cardboard segments are inserted within frames 32 and 36 and against their respective membranes 33. The separators are held in place by the walls of the packing container (not shown). The width 34 of the separators is slightly greater than depth 35 of the frame, which forces the cross-linked separator 34 into membrane 33. The articles 37, glasses in this embodiment, are positioned in line with the spaces between cross-linked members of the separators 31 between first and second membranes 33. When the symmetrical frame and separator assembly are brought together, the glasses are grabbed by the membranes which are stretched forming a series of cocoon like cells within said spaces.

Figure 10:
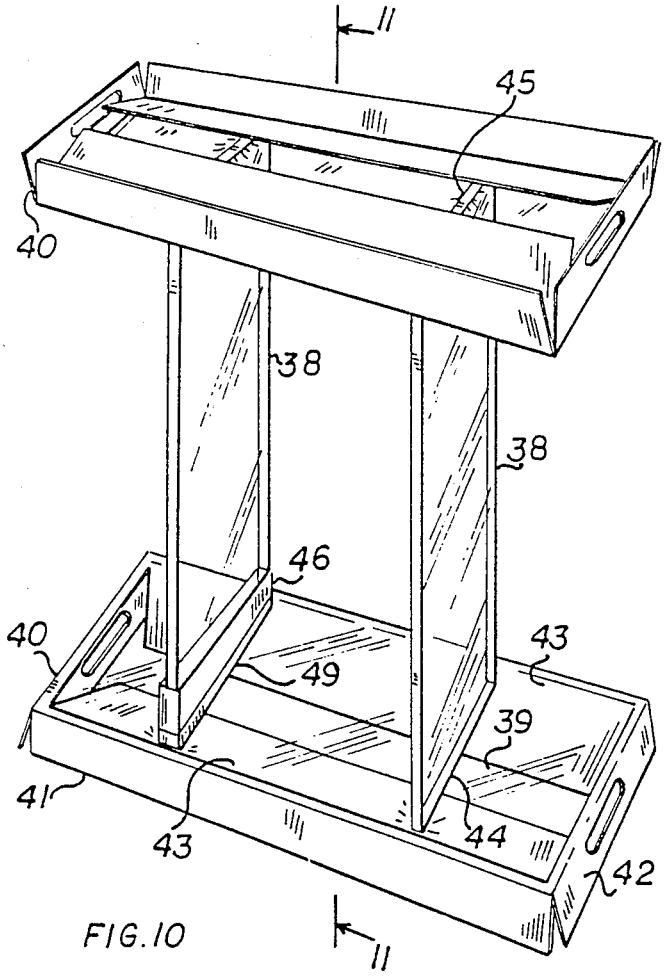
FIG. 10 shows a perspective view of a membrane packing for exceptionally heavy articles.

FIG. 10 is a perspective view of a membrane packing a of two exceptionally heavy (thick) panes of glass 38. Transparent membrane 39 is stretched across a folded cardboard insert 40. The folding outboard flaps (41, 42 and others not visible in this view) of cardboard insert 40 are held in place by the attached membrane 39 to form a duct-like structure. Interior flaps 43 are folded against the exterior package (not shown for clarity) near the bottom center of the duct-like insert 40 structure. The interior flaps 43 serve as an additional weight carrying structure to carry the heavy glass panes 38. The pliable membrane 39 partially supports the glass panes 38 along the bottom 44, but the corners of the bottom (through the pliable membrane also rest against the interior flaps 43. A similar packing duct-like structure is applied to the top edges 45 of the glass articles 38. The interior flaps may or may not support the article in this upper position, but allows the external container to be inverted without damage to the articles.

The other glass pane 38 is protected with a boot 46 covering the bottom 44 of the glass pane 38. The boot interfaces with the membrane 39, minimizing the possibility of sharp edges of the glass pane 38 puncturing the membrane 39. The boot helps distribute the weight of the glass pane 38. The boot also changes the frictional resistance and potential for relative movement between the article being shipped 38 and the membrane 39 when shock and vibration forces are applied to the package/-packing. If the article is to be nearly immobilized, a high static coefficient of friction can be achieved by adding a wrap interface to the boot 46 with a second membrane 49 to interface with the first membrane 39. With the boot, alternate interface wrap materials 49 can be selected to precisely adjust frictional resistance to limit loads which may be applied prior to relative motion between the booted article 38 and the membrane 39. Alternate boot configurations could also include cutouts to achieve different frictional resistances at different positions (loads) or an alternate method of adjusting overall frictional resistance. Cutouts could also provide relief to article protrusions at the interface.

Figure 11:
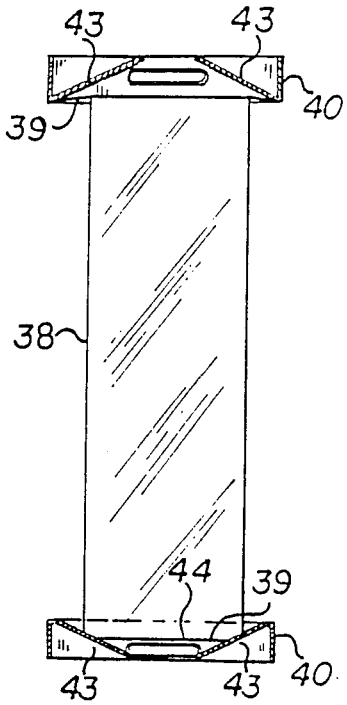
FIG. 11 shows a cross sectional view taken along line 11—11 of FIG. 10.

FIG. 11 is the cross sectional view of the membrane support for the glass panes 38. Pliable membrane 39 is stretched across the central opening of both the upper and lower packing duct-like frames 40. Flaps 43 do not contact the membrane 39 on the upper packing, nor do they partially support the glass panes 38 at the upper edge 45. Only the membrane 39 supports the upper edge 45 (see FIG. 10) of the article 38. However, the weight of the glass panes 38 force the bottom edge 44 and membrane 39 into the internal flaps 43 of the lower packing. Internal flaps 43 are supported by the remainder of the duct-like structure of the packing and the external package (not shown for clarity, similar to the container shown in FIG. 1). It should be noted that additional glass panes could be packaged between the two shown on the drawing.

Figure 12:
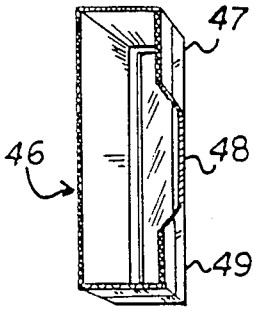
FIG. 12 shows a perspective view of a boot.

FIG. 12 shows a shipping boot 46. The boot is composed of cardlike material 47 having cutout 48. The cutout 48 is partially covered by second membrane 49. The first membrane 39 (see FIG. 10) mostly contacts second membrane 49 at the interface, with the cutout 48 primarily provided for ease of assembly and ease of removal. However, other cutout geometries can accommodate shipment of odd-shaped articles (see FIG. 10), and provide greater contact at the interface between the cardboard boot component 47 and the first membrane, or partial contact between the article to be shipped and the first membrane 39. Resistance to movement of the article 38 (see FIG. 10) being shipped would be dependent upon the frictional coefficients of friction of the first membrane 39 against the second membrane 49, the element 47, and the article 38. Further resistance to motion can be incorporated into flaps 43.

Alternate boot configurations could incorporate multiple openings, similar to the opening 48 shown, at the first membrane interface. Thus combinations of the frame 40, membranes 39, boots 46 and supporting flaps 43 can be varied to offer a wide range of protection for different types of articles.

FIG. 13 shows an exploded view of an alternate multi-article embodiment (articles being shipped not shown for clarity). A first frame packing 50 (similar to frame 3 as shown in FIG. 1) and membrane 51 is oppositely placed from second frame packing 52 and its membrane 51. A multi-article separator 53 is placed parallel to the opposing faces of the first and second frames 50 and 52. The separator 53 contains cutouts 54 shaped to conform to the articles being shipped (see FIG. 14). The multi-article separator positions articles held by the membranes 51 when the frames are biased towards each other by the external box 55 ends and flaps 56. The multi-article separator does not need to restrain the movement of articles under shock loads, but it may assist the membranes in holding the articles.

FIG. 14 is a front view of an open package as shown in FIG. 13. Flaps 56 are opened to expose the first frame 50 and attached transparent membrane 51. The multi-article separator 53 is visible through the transparent membrane 51, as are the cutouts 54 and multiple glass articles being shipped 57. The cutouts 54 may snugly fit the articles 57 or may only loosely position the articles 57. The packaging, when opened presents an attractive display of the articles, as well as providing protection and being usable for other articles. A new multi-article separator having different cutouts is all that is needed to allow the packaging to ship several other articles or unusually shaped objects. In an alternate embodiment, cutouts 54 in the multi-article separator are more generally shaped, only loosely positioning (and separating) articles being shipped. In this embodiment, the package may be used to ship other articles with no change in multi-article separator 53.

While the preferred and alternate embodiments of the invention have been shown and described, changes and modifications may be made therein within the scope of the appended claims without departing from the spirit and scope of this invention.

What is claimed is:

1. In combination with a rigid shipping container or the like, a packing device for resiliently suspending an object inside said container which comprises:

a first planar sheet of cardboard having a first opening;

a first film of pliable material covering said first opening and being attached on all sides to said first sheet;

a second planar sheet of cardboard having a second opening;

a second film of pliable material covering said second opening and being attached on all sides to said second sheet;

means for releasably securing said first and second sheets within said container in a generally parallel, spaced-apart and face-to-face alignment wherein each of said films is in pressing contact with opposite sides of said object sandwiched therebetween wherein the pliable films apply tension and friction to said object, and wherein said means for securing are shaped and positioned to apply equal forces to said sheets to immobilize said object between said films in the absence of any load being applied to said object other than gravity and in whatever position said container may rest and to limit, by tension and friction of the films applied to said object, the movement of said object within said container when said container is subject to impacts from various directions.

2. The combination of claim 1 which also comprises friction-increasing means interposed between each of said films and of said opposite sides of said object wherein said friction-increasing means comprise a surface in contact with said film made from the same material as said film.

3. The combination of claim 2, wherein said friction-increasing means also comprise a surface made of cardboard.

4. The combination of claim 1, also comprise an object separator made of cardboard, and shaped and dimensioned to separate multiple objects held between said films.

5. The combination of claim 4, wherein said object separator is a planar section of cardboard having a plurality of apertures.

6. The combination of claim 5 wherein said planar separator in placed parallel to said frame elements, said separator having openings, each opening large enough to pass a portion of one of said multiple objects.

* * * * *